US008052922B2

(12) United States Patent
Boranbaev et al.

(10) Patent No.: US 8,052,922 B2
(45) Date of Patent: Nov. 8, 2011

(54) ROTARY BATCH DISTRIBUTOR

(75) Inventors: Bekmurat Meketaevich Boranbaev, Moscow (RU); German Vasilievich Abramin, Moscow (RU); Yury Alexandrovich Smirnov, Moscow (RU); Andrey Mikhailovich Dyatlov, Moscow (RU); Alexander Yurievich Glazer, Moscow (RU)

(73) Assignee: Zakrytoe Aktsionernoe Obschestvo "Nauchno-Proizvodstvenny I Kommerchesky Tsentr "Totem", Moscow (RU)

( * ) Notice: Subject to any disclaimer, the term of this patent is extended or adjusted under 35 U.S.C. 154(b) by 654 days.

(21) Appl. No.: 12/159,308

(22) PCT Filed: Dec. 26, 2006

(86) PCT No.: PCT/RU2006/000702

§ 371 (c)(1),
(2), (4) Date: Oct. 17, 2008

(87) PCT Pub. No.: WO2007/089169

PCT Pub. Date: Aug. 9, 2007

(65) Prior Publication Data

US 2010/0028116 A1 Feb. 4, 2010

(30) Foreign Application Priority Data

Dec. 30, 2005 (RU) ..... 2005141570

(51) Int. Cl.
*C21B 7/08* (2006.01)

(52) U.S. Cl. ..... 266/199; 266/176; 414/160; 414/199; 414/302; 414/588

(58) Field of Classification Search ..... 414/160, 414/172, 199, 208, 302, 304, 586, 587, 588; 266/176, 199

See application file for complete search history.

(56) References Cited

U.S. PATENT DOCUMENTS 4,419,036 A 12/1983 Beckenbach et al.
5,965,085 A * 10/1999 Abramin et al. ..... 266/199

FOREIGN PATENT DOCUMENTS

RU 2136762 C1 9/1999
WO 9219776 A1 12/1992

* cited by examiner

*Primary Examiner* — Scott Lowe
(74) *Attorney, Agent, or Firm* — Volpe and Koenig, P.C.

(57) ABSTRACT

The invention relates to the iron and steel industry, in particular to batch charging into shaft, mainly blast furnaces. The inventive rotary batch distributor for shaft furnaces comprises an axle platform (1) and blades (2) which are equally spaced around the platform and are fixed thereto by means of brackets (3). The surface of each blade is embodied in the form of an involute of a truncated cone and consists of trapezoidal sections (4). The tilting angles of the trapezoidal sections with respect to the rotary batch distributor axis and to a horizontal plane are defined by the involutes (5) of truncated cone which are focused at the same point of the rotary batch distributor axis. The surface area of each blade is defined by the sector angle value ranging from 90 to 120° and by the radius of the describe circle of the rotary batch distributor. The end part (6) of the blade whose surface area is equal to 0.05-0.10 of the blade surface area is arranged at an angle of 125-140° with respect to the previous section. The tilting angle of a generator passing through the base of the end part of the blade to the rotary batch distributor axis ranges from 88 to 90°. Said invention makes it possible to provide any specified profile of the feedstock surface, starting from a cone-shaped whose tip is arranged on the blast furnace axis to a peripheral, with a high circumferential uniformity.

3 Claims, 2 Drawing Sheets

ROTARY BATCH DISTRIBUTOR

The invention relates to the iron and steel industry, in particular to production of metals in shaft, mainly blast furnaces, and is useful for charging batch materials into shaft furnaces.

A conventional rotary batch distributor employed in a charging apparatus of a shaft furnace comprises a hub and guiding members that are uniformly spaced around the hub (RU No. 2067792, C21B 7/20, Oct. 10, 1996).

The guiding members (blades) of the batch distributor are formed by two successive rigid sections—an edge chute and a discharging surface with a rigid rib having a triangular section and directed obliquely toward the hub axis.

The main drawback of known rotary batch distributor is that its operation does not ensure loading the batch material into the axial region of the shaft furnace.

Most closely related to the technical matter and effect of the present invention is a rotary batch distributor for a shaft furnace, comprising an axle platform and at least two blades which are equally spaced around and fixed to the platform by means of support brackets extending radially from the rotor axis (RU No. 2136762, C21B 7/10, Mar. 20, 1998).

In the rotary batch distributor, each blade is mounted at an angle to the horizontal plane and comprises two sections arranged in line with the batch flow, a first section being in the close vicinity of the horizontal element, and a second section being formed by at least two flat surfaces with the unload edge facing the furnace cavity. Surfaces of the blades are arranged so that when they are intersected by the vertical plane passing through the geometrical center of each surface and tangentially to the circumference with the center at the furnace axis, a broken line is formed, each successive length of the broken line having the angle of inclination to the horizontal plane greater than that of the preceding length; this enables, at a small rotary speed of the rotor, depositing the batch material closer to the furnace axial region, charging thereby the center of the furnace top. The tilting angle of the surfaces to the furnace axis with respect to the horizontal plane, in line with the batch flow, also increases, so that the center of the furnace top zone can be charged at low rotary speeds of the rotor.

As follows from the description of the known solution, the structure of the prior art rotary batch distributor makes it possible to charge the peripheral part of the furnace top zone at maximum rotary speed, the central part at intermediate rotary speed and the axial part at minimum rotary speed.

Studies have shown that the structure of the rotary batch distributor enables, by varying the speed of its rotation in only one direction, the provision of substantially any predetermined surface profile of the batch in the furnace top zone, but at a minimum rotary speed and even at full stop the structure fails to provide charging the batch material in the center of the furnace top zone as a cone with the vertex on the blast furnace axis, this impairing the ability of controlling gas distribution over the furnace cross-section with the aid of the structure of the rotary batch distributor when it rotates in only one direction. To provide cone-shaped charge of the batch into the furnace top center, the direction of the rotor distributor rotation should be reversed, but this prevents uniform and continuous charging of a single batch load from the center to periphery. Furthermore, surfaces of the rotary batch distributor blades have a rather irregular shape that is not definitely specified, so fabrication of the blades is cumbersome and the use of the distributor involves difficulties due to the nonlinear relationship between radial distribution of the batch and rotary speed of the rotary distributor.

The object of the present invention is to provide a rotary batch distributor which makes it possible, when rotating in only one direction, to obtain any predetermined profile of the feedstock surface and enables loading of the batch material, as a cone with the vertex on the blast furnace axis, into the center of the furnace top zone, and uniform and continuous depositing of a batch load from the center to the periphery.

The invention provides a more efficient control of distributing the feedstock over the radius of the furnace top. The object of the invention is attained by a rotary batch distributor for a shaft furnace, comprising an axle platform and at least three blades which are equally spaced around and fixed to the axle platform by means of support brackets extending radially from the axle platform, wherein a surface of each of the blades is configured as an involute of a truncated cone, each of the blades consists of at least three trapezoidal sections, tilting angles of the trapezoidal sections with respect to an axis of the rotary batch distributor and to the horizontal plane are defined by the truncated cone generators bounding the sections and meeting at the same point (F) on the axis of the rotary batch distributor, position of the point being defined by the intersection between the axis of the rotary batch distributor and the generator passing through the attachment point of the blade to the rotary batch distributor at an angle of 50-65° with respect to the axis of the rotary batch distributor, the blade surface area is defined by a value of sector angle ($\gamma$) ranging from 90° to 120° and by the radius of the circumscribed circumference of the rotary batch distributor, (Rp), the blade end part having a surface area equal to 0.05-0.10 of the blade surface area is arranged at an angle of 125-140° with respect to the previous section, and the tilting angle of the generator passing through the base of the end part of the blade with respect to the axis of the rotary batch distributor ranges from 88° to 90°. The tilting angle of the support bracket with respect to the axis of the rotor distributor ranges from 70° to 85°.

Radius of the circumscribed circle of the support brackets is 0.7-0.9 of the radius of the rotary batch distributor.

The value of 50-65° of the angle between the truncated cone generator passing through the attachment point of the blade to the support bracket and the axis of the rotary distributor is dictated by the fact that at a smaller angle (<50°) charging the batch material to the central region is hampered by the predominant effect of gravity forces, while at a greater angle (>65°) charging the batch material to the periphery is hampered by the predominant effect of centrifugal forces.

The blade area is restricted by a sector angle of 90-120° because at a smaller angle (<90°) there is no time to form a sufficiently wide batch flow distributed over the area, this hampering the radial distribution adjustment through varying the rotary speed of the rotor, while at a greater angle (>120°) the blade area is excessive and used inefficiently, this resulting in unreasonably oversized and overweight rotor.

Parameters of the blade end part (surface area of 0.05-0.10 of the total area of the blade surface; arrangement at an angle of 125-140° with respect to the preceding section, and the tilting angle of the generator passing through the base of the blade end part to the axis of the rotor distributor equal to 88-90°) have been determined experimentally on the basis of the testing results of a rotor distributor model. The parameters provide optimal crest formation and flexible control of the radial distribution of batch material in the intermediate zone of the furnace top.

The tilting angle of the support bracket with respect to the axis of the rotary distributor is 70-85° because just this range provides a normal flow of the batch on the axle platform and its distribution over the blades, and eliminates ejection of the batch material beyond the leading parts of the blades.

Owing to the unique design of the blade surfaces, the rotary batch distributor ensures any predetermined profile of the feedstock surface, from a cone-shaped profile whose vertex is on the blast furnace axis to a peripheral profile immediately against the furnace wall, with a high circumferential uniformity.

The invention will be further explained in more details with reference to the following schematic drawings wherein.

Figure 3:
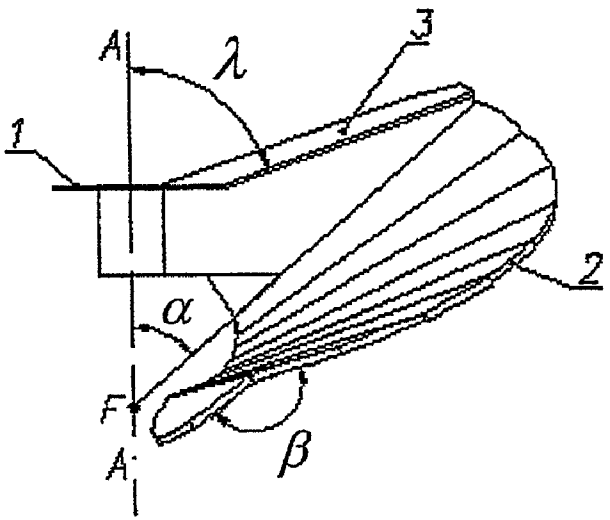
FIG. 3 shows a blade with a bracket.
Figure 1:
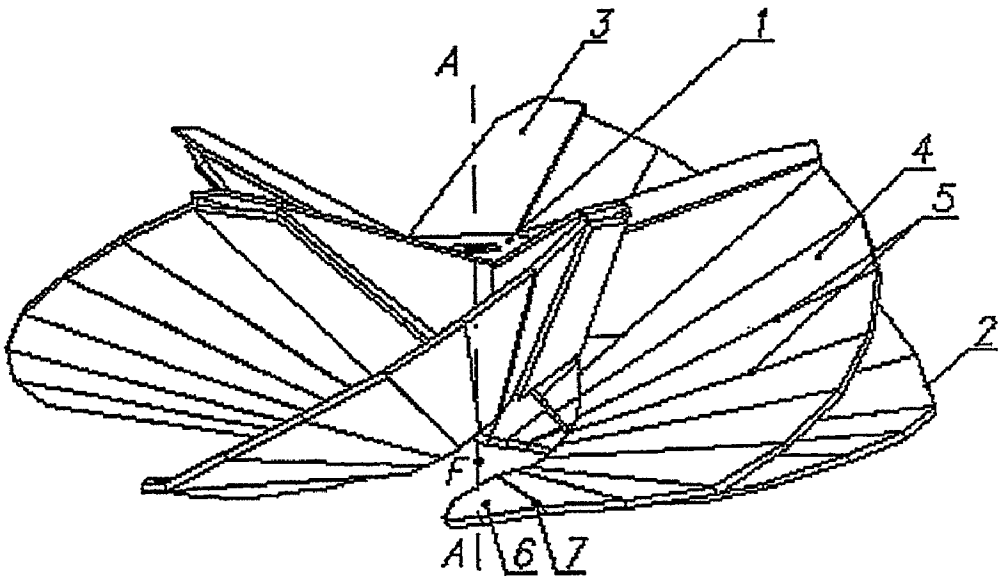
FIG. 1 shows a general view of a rotary batch distributor.
Figure 2:
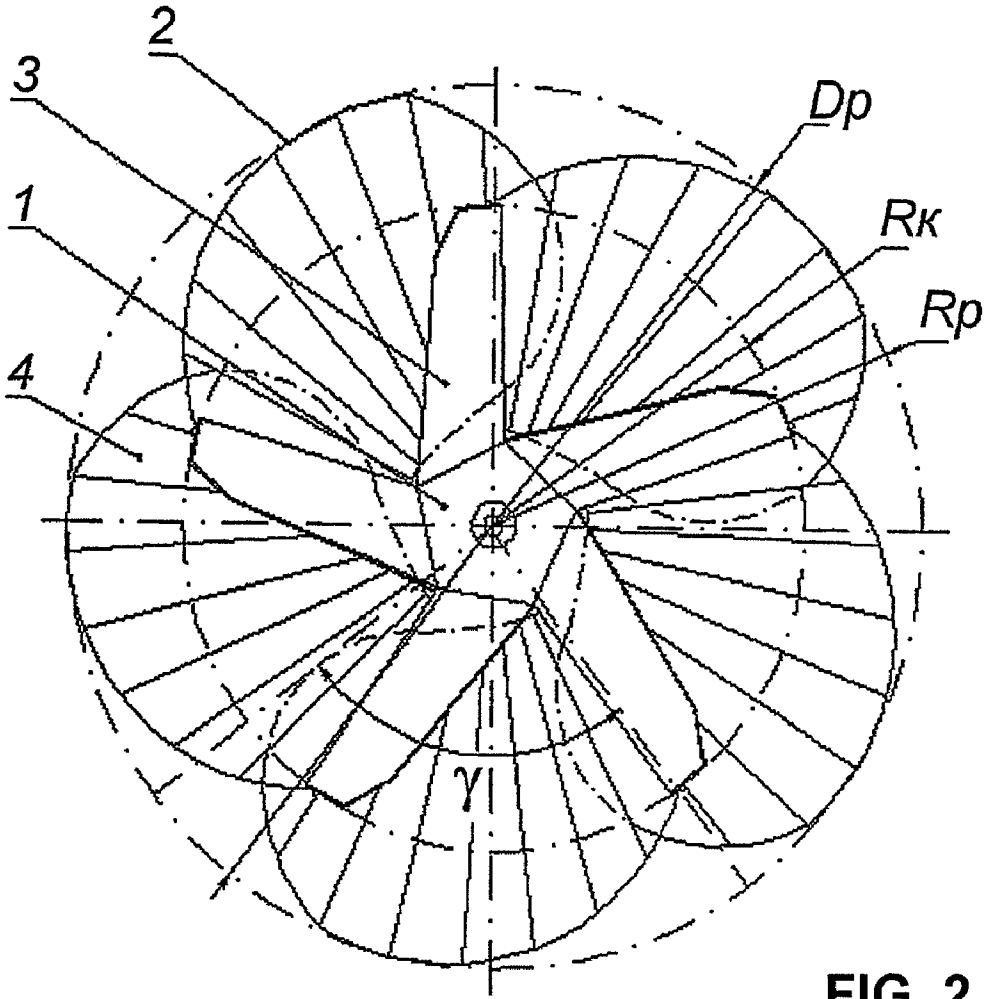
FIG. 2 shows a plan view of a rotary batch distributor.

A rotary batch distributor comprises an axle platform 1 and blades 2 which are equally spaced around the axle platform 1 and fixed thereto by means of support brackets 3 equally spaced and radially extending from the axle platform 1. Surface of each blade 2 is configured as an involute of a truncated cone. Each of the blades 2 consists of at least three trapezoidal sections 4. Tilting angles of the trapezoidal sections 4 forming the surface of each blade 2 with respect to axis A-A of the rotary batch distributor and the horizontal plane are defined by the truncated cone generators bounding the trapezoidal sections 4. The truncated cone generators 5 meet at the same point (F) on axis A-A of the rotary batch distributor. Position of point F is defined by the intersection between axis A-A of the rotary batch distributor and the generator 5 passing through the attachment point of the blade to the rotary batch distributor at angle ($\alpha$) of 50-65° with respect to axis A-A of the rotary batch distributor. Area of each blade is restricted by a value of sector angle ($\gamma$) ranging from 90° to 120° and the radius of the circumscribed circle of the rotary batch distributor, (Rp). The blade end part having a surface area of 0.05-0.10 of the surface area of the blade 2 is inclined at angle ($\beta$) of 125-140° with respect to the preceding section. The tilting angle with respect to axis A-A of the generator 7 passing through the base of the blade end part 6 of the rotary batch distributor ranges from 88° to 90°. Tilting angle ($\lambda$) of the support bracket 3 with respect to axis A-A of the rotor distributor ranges from 70° to 85°.

The diameter of the circumscribed circle, (Dp), around the rotary distributor is 0.6-0.8 of the diameter of the cylindrical part of the furnace top, while the radius of the circumscribed circle around the support brackets, (Rk), is 0.7-0.9 of the rotary distributor radius, (Rp).

Surface of the blade may be formed by at least three flat trapezoidal sheets.

The rotary batch distributor is mounted in the top space along the blast furnace axis and connected to the rotary drive.

The rotary batch distributor operates in the following manner.

When charged in a blast furnace, a batch load falls first on an axle platform 1 and surfaces of brackets 3, then on surfaces of blades 2 of the rotary distributor, that are formed by trapezoidal sections 4, and after that the batch material falls from the blade surfaces into the furnace top zone, on the feedstock surface.

Where the rotary distributor rotates at a low speed, owing to a great initial tilting angle ($\alpha$) of the blade 2 at the attachment point to the support bracket 3 and a relatively small tilting angle of the blade with respect to the horizontal plane, substantially all of the batch load is deposited as a cone in the center of the furnace top zone.

Where the rotary distributor rotates at a middle speed, the main batch flow moves under the centrifugal force to the end part of the blades 2, and the charge in the middle part of the furnace top zone forms an annular crest, whose formation in transient conditions is promoted by the design of the end part of the blades 6.

Increase in the rotary speed of the rotor distributor to the maximum results in that the main part of the batch, falling from the external part of the blades 2, will be deposited over the periphery, immediately against the furnace wall.

Where the rotary speed of the rotary distributor changes, in the course of charging a batch load, from minimum to maximum the batch will be deposited helically—from the axis of the furnace top zone towards its periphery.

Therefore, the inventive rotary batch distributor makes it possible, when rotating in only one direction, to provide any predetermined profile of the feedstock surface with a high circumferential uniformity.

Use of the rotary distributor for charging a blast furnace further ensures the formation of a central (axial) air hole, as well as a peripheral zone with a reduced ore load, which defines descend of the batch, development of reduction and thermal process, and the state of furnace brickwork. Combination of the central (axial) and peripheral air holes affects the structure of the stock column, efficiency of thermal and chemical energy of gases and, as consequence, energy intensity of the melt.

Application of the invention can substantially improve efficiency of the furnace and reduce consumption of coke.

The invention claimed is:

1. A rotary batch distributor for a shaft furnace, comprising an axle platform and at least three blades which are equally spaced around and fixed to the axle platform by means of support brackets extending radially from the axle platform, wherein the surface of each of the blades is configured as an involute of a truncated cone, each of the blades consists of at least three trapezoidal sections, tilting angles of the trapezoidal sections with respect to an axis of the rotary batch distributor and to the horizontal plane are defined by truncated cone generators bounding the sections and meeting at the same point (F) on the axis of the rotary batch distributor, position of the point being defined by the intersection between the axis of the rotary batch distributor and the generator passing through an attachment point of the blade to the support bracket at an angle of 50-65° with respect to the axis of the rotary batch distributor, the blade surface area is restricted by a value of sector angle ($\gamma$) ranging from 90° to 120° and by the radius of the circumscribed circle of the rotary batch distributor (Rp), the blade end part having a surface area equal to 5-10% of the blade surface area is arranged at an angle of 125-140° with respect to the previous section, and the tilting angle of the generator passing through the base of the blade end part with respect to the axis of the rotary batch distributor ranges from 88° to 90°.

2. The rotary batch distributor according to claim 1, characterized in that the tilting angle of the support bracket with respect to the axis of the rotary batch distributor is between 70° and 85°.

3. The rotary batch distributor according to claim 1, characterized in that the radius of the circumscribed circle of the support brackets is 70-90% of the radius of the rotary distributor.

* * * * *